US010358698B2

(12) United States Patent
Otsuka et al.

(10) Patent No.: US 10,358,698 B2
(45) Date of Patent: Jul. 23, 2019

(54) HEAT RESISTANT TITANIUM ALLOY MATERIAL FOR EXHAUST SYSTEM PART USE EXCELLENT IN OXIDATION RESISTANCE, METHOD OF PRODUCTION OF HEAT RESISTANT TITANIUM ALLOY MATERIAL FOR EXHAUST SYSTEM PART USE EXCELLENT IN OXIDATION RESISTANCE, AND EXHAUST SYSTEM

(71) Applicant: NIPPON STEEL & SUMITOMO METAL CORPORATION, Tokyo (JP)

(72) Inventors: Hiroaki Otsuka, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/853,291

(22) Filed: Dec. 22, 2017

(65) Prior Publication Data

US 2018/0195154 A1 Jul. 12, 2018

Related U.S. Application Data

(63) Continuation-in-part of application No. 13/516,886, filed as application No. PCT/JP2010/073257 on Dec. 16, 2010, now abandoned.

(30) Foreign Application Priority Data

Dec. 28, 2009 (JP) ..... 2009-297594

(51) Int. Cl.

| | |
|---|---|
| ***C22C 14/00*** | (2006.01) |
| ***C22F 1/18*** | (2006.01) |
| ***G10K 11/162*** | (2006.01) |
| ***F01N 13/16*** | (2010.01) |
| ***F01N 3/10*** | (2006.01) |
| ***F01N 13/08*** | (2010.01) |
| ***F01N 13/10*** | (2010.01) |
| ***F01N 1/00*** | (2006.01) |

(52) U.S. Cl.

CPC ..... *C22C 14/00* (2013.01); *C22F 1/183* (2013.01); *F01N 1/00* (2013.01); *F01N 3/10* (2013.01); *F01N 13/08* (2013.01); *F01N 13/10* (2013.01); *F01N 13/16* (2013.01); *G10K 11/162* (2013.01); *F01N 2530/02* (2013.01)

(58) Field of Classification Search

CPC ..... C22C 14/00; C22F 1/183

See application file for complete search history.

(56) References Cited

U.S. PATENT DOCUMENTS

2005/0202271 A1* 9/2005 Yashiki ..... B32B 15/017 428/660

2007/0187008 A1 8/2007 Fujii et al.

FOREIGN PATENT DOCUMENTS

| | | | |
|---|---|---|---|
| JP | 11-335759 | A | 12/1999 |
| JP | 2001-234266 | A | 8/2001 |
| JP | 2005-290548 | A | 10/2005 |
| JP | 2005-298870 | A | 10/2005 |
| JP | 2007-100171 | A | 4/2007 |
| JP | 2009-030140 | A | 2/2009 |
| JP | 2009-68026 | A | 4/2009 |

OTHER PUBLICATIONS

Final Office Action dated Apr. 18, 2016, issued in U.S. Appl. No. 13/516,886.

Final Office Action dated Apr. 23, 2014, issued in U.S. Appl. No. 13/516,886.

International Search Report dated Mar. 22, 2011, issued in PCT Application No. PCT/JP2010/073257 (Form PCT/ISA/210).

Material Properties Handbook: Titanium Alloys, ASM International The Materials Information Society, Jun. 1994, pp. 167-169, 483-486.

Non-Final Office Action dated Aug. 14, 2013 in U.S. Appl. No. 13/516,886.

Non-Final Office Action dated Jul. 8, 2015, issued in U.S. Appl. No. 13/516,886.

Non-Final Office Action dated Jun. 22, 2017, issued in U.S. Appl. No. 13/516,886.

* cited by examiner

*Primary Examiner* — Veronica F Faison

(74) *Attorney, Agent, or Firm* — Birch, Stewart, Kolasch & Birch, LLP

(57) ABSTRACT

A titanium alloy material for exhaust system parts excellent in oxidation resistance and cold workability able to be used for an exhaust manifold, exhaust pipe, catalyst device, muffler, or other part characterized by containing, by mass %, Cu: 0.5 to 1.5%, Sn: 0.5 to 1.5%, Si: 0.1% to 0.6%, O: 0.1% or less, and Fe: 0.15% or less, and a balance of Ti and impurities, having a total of the contents of Cu and Sn of 1.4 to 2.7%, and having a total of the volume rates of the β-phases and Ti—Cu and Ti—Si intermetallic compounds of 1.0% or less.

3 Claims, No Drawings

HEAT RESISTANT TITANIUM ALLOY MATERIAL FOR EXHAUST SYSTEM PART USE EXCELLENT IN OXIDATION RESISTANCE, METHOD OF PRODUCTION OF HEAT RESISTANT TITANIUM ALLOY MATERIAL FOR EXHAUST SYSTEM PART USE EXCELLENT IN OXIDATION RESISTANCE, AND EXHAUST SYSTEM

TECHNICAL FIELD

The present invention relates to a titanium material used for an exhaust system for four-wheeled vehicles, motorcycles, and other automobiles and relates as well as to a titanium alloy material which is light in weight and excellent in corrosion resistance, workability, heat resistance, and oxidation resistance able to be used for a main muffler part of course and also an exhaust manifold, exhaust pipe, catalyst device, muffler, or other location which is temporarily exposed to a high temperature of near 800° C. and where heat resistance and oxidation resistance are particularly required and to an exhaust system using this titanium alloy material.

BACKGROUND ART

Titanium materials are light in weight, yet high in strength and excellent in corrosion resistance, so are being used even for the exhaust systems of automobiles. The combustion gas discharged from the engines of automobiles and motorcycles is collected at an exhaust manifold and discharged by an exhaust pipe from an exhaust outlet at the rear of a vehicle.

An exhaust pipe is formed split into several segments to enable insertion of a catalyst device which carries or is coated with a catalyst or of a muffler in the middle. In this Specification, the entire system from the exhaust manifold to the exhaust pipe and exhaust outlet will be called an "exhaust system".

For the materials for such an exhaust system, in place of the conventional stainless steel material, from the viewpoint of reducing the weight of the vehicle, JIS class 2 commercially pure titanium material is being used—mostly for motorcycles. Furthermore, recently, in place of the JIS class 2 commercially pure titanium material, a titanium alloy with a higher heat resistance is used. Further, in recent years, to remove harmful ingredients from exhaust gas, mufflers which carry catalysts which are used at a high temperature are also being used. In addition, to obtain the most suitable structure when mounted in a vehicle, more severe bulging or drawing becomes necessary. Materials excellent in these become necessary.

The temperature of exhaust gas sometimes exceeds 700° C. and temporarily even reaches 800° C. For this reason, in materials which are used for exhaust systems, indicators such as the strength at a temperature around 800° C., oxidation resistance, creep speed at 600 to 700° C., and other aspects of high temperature heat resistance are stressed. Ti-3Al-2.5V alloy is excellent in the point of high temperature strength.

In PLT 1, a titanium alloy which is excellent in oxidation resistance and corrosion resistance is proposed.

In PLT 2, a heat resistant titanium alloy sheet which is excellent in cold workability and a method of production of the same are proposed.

In PLT 3, a titanium alloy with a surface covered by a protective film is proposed.

In PLT 4, a titanium alloy which is excellent in high temperature strength at 700° C. and oxidation resistance at 800° C. is proposed.

CITATIONS LIST

Patent Literature

[PLT 1] Japanese Patent Publication (A) No. 2005-290548

[PLT 2] Japanese Patent Publication (A) No. 2005-298970

[PLT 3] Japanese Patent Publication (A) No. 2007-100171

[PLT 4: Japanese Patent Publication (A) No. 2009-68026

SUMMARY OF INVENTION

Technical Problem

The characteristics required when producing an exhaust system are the high temperature strength, oxidation resistance, and other high temperature characteristics of course and also the bulging ability and drawing ability. A Ti-3Al-2.5V alloy excellent in high temperature strength is insufficient in oxidation resistance at 800° C. in recent years. The Erichsen value is low, so use as a material for an exhaust system has been difficult. For this reason, up until now, materials having the high temperature characteristics of the level required as a material for exhaust system use and better in workability than a Ti-3Al-2.5V alloy have been developed.

PLT 1 discloses a titanium alloy which contains, by mass %, Al: 0.30 to 1.50%, Si: 0.10 to 1.0%, and Nb: 0.1 to 0.5%. This titanium alloy is considered to be improved in high temperature strength and oxidation resistance, but contains large amounts of Si extremely easily forming intermetallic compounds, so there is a concern over an inferior Erichsen value or bulging ability or drawing ability.

PLT 2 discloses a titanium alloy which contains, by mass %, Cu: 0.3 to 1.8%, O: 0.18% or less, Fe: 0.30% or less, and, as needed, furthermore, one or more of Sn, Zr, Mo, Nb, and Cr in a total of 0.3 to 1.5% and has a balance of Ti and less than 0.3% of impurity elements. However, a usage environment of up to 700° C. is envisioned, so high temperature characteristics up to 800° C. recently considered necessary are not sufficient.

PLT 3 proposes a Ti—Cu alloy and Ti—Cu—Nb alloy sheet which are coated with a protective film containing, by mass %, Si: 15 to 55%, C: 10 to 45%, and Al: 20 to 60%. When coating a protective film on a titanium alloy sheet, if the processing includes welding, the formed film will be melted away and the weld zone will become hard, so there is a concern over cracking in the expansion and drawing of a welded tube. Also, if performing the demanded severe working, there is the problem of the protective film peeling off.

PLT 4 proposes an alloy which contains, by mass %, Cu: 0.5 to 1.8%, Si: 0.1 to 0.6%, and O: 0.1% or less and, as needed, Nb: 0.1 to 1.0% and has a balance of Ti and unavoidable impurities. This alloy improves the oxidation resistance up to a higher temperature, but unlike PLT 2, Si, which precipitates extremely easily as intermetallic compounds, is added, so in the same way as PLT 1 in which Si is added, the bulging ability and drawing ability may become inferior.

In view of the above situation, the present invention has as its task the provision of a heat resistant titanium alloy material for exhaust system parts which is excellent in high temperature strength, oxidation resistance, and workability (bulging ability and drawing ability) able to be used for exhaust manifolds, exhaust pipes, catalyst devices, mufflers, and other locations which are temporarily exposed to high temperatures of 800° C. or higher and of an exhaust system using that alloy material.

Solution to Problem

The present invention solves the problem by the following:

(1) A titanium alloy material containing, by mass %, Cu: 0.5 to 1.5%, Sn: 0.5 to 1.5%, Si: over 0.1% to 0.6%, O: 0.10% or less, Fe: 0.15% or less, and a balance of Ti and impurities, having the total of the contents of Cu and Sn of 1.4 to 2.7%, and having the sum of the volume rates of the β-phases and Ti—Cu and Ti—Si intermetallic compounds of 1.0% or less (below, referred to as the "Present Invention (1)".

(2) The titanium alloy material according to (1), further containing, by mass %, Nb: 1.0% or less (below, referred to as the "Present Invention (2)".

(3) An exhaust system comprising an exhaust manifold, exhaust pipe, catalyst device, and muffler, the exhaust system characterized by using a titanium alloy material described in (1) or (2) for one or more of the exhaust manifold, exhaust pipe, catalyst device, and muffler (below, referred to as the "Present Invention (3)".

Advantageous Effects of Invention

According to the present invention, it is possible to obtain a heat resistant titanium alloy material for exhaust system parts which has sufficient strength at a high temperature, which is superior in oxidation resistance, and which is excellent in cold workability and to obtain an exhaust system using this alloy material.

DESCRIPTION OF EMBODIMENTS

Below, the "%" in the components shall be deemed to express "mass %".

Cu, one of the alloy elements in the present invention, forms a solid solution in the α-phases of titanium up to 2.1% at a high temperature of 790° C. In a titanium alloy in which Cu forms a solid solution, Ti—Cu intermetallic compounds precipitate in the process of cooling. The amount of precipitation is determined by the content of Cu and the annealing temperature. This is also affected by elements which are simultaneously included, but the amount of solid solution of Cu alone becomes a maximum of 2.1% at about 790° C. If higher or lower than this temperature, the amount of solid solution falls.

The high temperature strength is improved if increasing the content of Cu since the amount of Cu forming a solid solution in the α-phases increases. However, if the amount of Cu becomes greater, while depending on the heat treatment conditions as well, the Cu not forming the solid solution remains as Ti—Cu intermetallic compounds and the intermetallic compounds grow in the cooling process, the amount of precipitation of Ti—Cu intermetallic compounds becomes greater, and the cold workability falls.

The cold workability is evaluated by various methods of evaluation, but the elongation in the tensile test is evaluated by the single axis tensile stress, while the Erichsen value is evaluated by the tensile stress of the equibiaxis, so is evaluated in the actual state of working of the exhaust manifold, exhaust pipe, catalyst device, muffler, etc.

That is, to obtain the high temperature strength of a certain level or more without lowering the Erichsen value, other than the amount of Cu in the α-phases, inclusion of other α-phase solution strengthening elements is effective for reducing the above problems.

Almost all of the alloy elements contained in the titanium are β-phase stabilizing elements. Sn is suitable as an element for suppressing the β-phases while forming a solid solution in the α-phases. By inclusion of Sn, inclusion of excessive Cu becomes no longer necessary, so it is possible to suppress undissolved Ti—Cu intermetallic compounds and possible to suppress the growth of the intermetallic compounds during cooling. Simultaneously, there is also the effect of suppression of precipitation of Ti—Cu intermetallic compounds even at a relatively low heat treatment temperature and the high temperature strength is improved.

However, the greater the amount of Sn or the amount of O, the more the solid solubility limit of the Cu at the time of Cu solid solution annealing falls and the easier it is for Ti—Cu intermetallic compounds to precipitate, so the content of Cu has to be sufficiently managed. Ti—Cu intermetallic compounds, if once completely dissolved, do not precipitate much at all since the precipitation rate is slow even with a cooling rate of the extent of furnace cooling at the time of BAF annealing.

On the other hand, the Si contained for improving the oxidation resistance is narrow in solid solubility limit in the high temperature region and fast in precipitation rate, so with BAF annealing etc., Ti—Si intermetallic compounds precipitate. If the amount is great, this becomes a factor reducing the cold workability and lowering the Erichsen value.

Furthermore, oxygen lowers the room temperature ductility, so it is necessary to keep low the content in order to secure a cold workability on a par with pure titanium.

A high temperature oxidation resistance at a high temperature of over 700° C. is obtained by inclusion of Si and Nb.

Si forms Ti—Si intermetallic compounds on the surface layer and thereby forms a barrier layer when exposed to a high temperature. As a result, diffusion of oxygen to the inside of the titanium is suppressed, so excellent oxidation resistance is obtained.

Furthermore, by including Nb, the oxidation resistance is improved, in particular even at a temperature exceeding 800° C., so a sufficient oxidation resistance at 800° C. can be secured. Nb dissolves in the oxide film of the titanium. Titanium is tetravalent, while Nb is pentavalent, so if Nb dissolves in the oxide film of the titanium, the atomic vacancy concentration of oxygen in the oxide film of the titanium falls and diffusion of oxygen in the oxide film is further suppressed compared with inclusion of Si alone.

The oxidation of titanium is a form of oxidation called "inward diffusion" wherein oxygen diffuses inward through the oxide film and bonds with titanium on the surface of the base material. Therefore, if diffusion of oxygen in the oxides is suppressed, oxidation is suppressed.

Inclusion of a suitable amount of Nb is effective for raising the strength at high temperature, but has no effect on the cold workability. That is, if including a suitable amount of Nb to the Ti—Cu—Sn—Si alloy, there is almost no effect on the cold workability and titanium alloy with an elevated high temperature strength even in a temperature region exceeding 800° C. and an excellent oxidation resistance can be easily obtained.

The titanium alloy of the present invention is excellent in high temperature strength and cold workability in particular near 800° C. and in oxidation resistance near 800° C. By including Nb, the characteristics are stable even at a temperature region exceeding 800° C. and oxidation resistance at 800° C. can be sufficiently secured.

The high temperature strength of the titanium alloy of the present invention is at least 1.5 times the 0.2% proof stress in the rolling direction at 800° C. of JIS class 2 commercially pure titanium, that is, 18 N/mm$^2$ or more, so this contributes to the ability of exhaust system parts to handle high temperatures. The superiority becomes clear.

If the 0.2% proof stress at 800° C. is 18 N/mm$^2$ or more, as one example, the muffler temperature of the vehicle during operation will temporarily rise up to 800° C. Even when up-down vibration etc. at the time of vehicle operation causes force to be applied to the muffler, the muffler is resistant to deformation. As a result, the degree of freedom in muffler design is increased.

On the other hand, in forming a muffler, bulging and deep drawing are performed, so to obtain sufficient workability for this, the Erichsen value at room temperature should be 10 mm or more of JIS class 2 or more with Teflon sheet lubrication.

If the Erichsen value is equal to or better than that of the JIS class 2, the experience and knowhow in various cold working operations of users using the JIS class 2 material can be utilized fully as they are. For this reason, users can easily study production of the present invention material on actual industrial production lines and, as a result, easily incorporate it into industrial production lines now in operation where as much operating time as possible is desired to be secured.

For the indicator of the oxidation resistance, the increase in mass by oxidation due to heating at 800° C. in the air for 200 hours is used. If the increase in mass by oxidation is 65 g/m$^2$ or less, the growth of the surface oxidation layer due to the inward diffusion control of oxygen is substantially saturated and the thickness is maintained at one where almost no peeling of the surface oxidation layer occurs.

Next, the reasons for limitation of the titanium alloy material of the present invention (1) will be explained.

If the amount of inclusion of Cu is less than 0.5%, the amount of Cu which forms a solid solution in the titanium alloy becomes smaller, so even if jointly contained with Sn, the 0.2% proof stress at 800° C. will not become 18 N/mm$^2$ or more. If the content of Cu is greater than 1.5%, at the time of solution heat treatment of Cu, the solid solution temperature range of the Ti—Cu intermetallic compounds becomes narrower and in addition the grain growth is suppressed and fine grains result, so the Erichsen value at room temperature does not reach 10 mm. Further, Ti—Cu intermetallic compounds more easily precipitate in the heat treatment process after the solution heat treatment. This precipitation occurs preferentially at the grain boundaries. The Ti—Cu intermetallic compounds become sizes and forms not contributing much at all to strength. As a result, even if included simultaneously with Sn, the 0.2% proof stress at 800° C. is liable to not reach 18 N/mm$^2$.

If the content of Sn is less than 0.5%, the amount of Sn which forms a solid solution in the titanium alloy becomes smaller, so even if jointly contained with Cu, the 0.2% proof stress at 800° C. will not become 18 N/mm$^2$ or more. If the content of Sn is greater than 1.5%, twinning deformation of titanium is suppressed, the cold workability deteriorates, and the Erichsen value at room temperature does not reach 10 mm.

If the total of the contents of Cu and Sn is less than 1.4%, the amounts of Cu and Sn which form solid solutions in the α-phases of the titanium alloy become smaller, so the 0.2% proof stress at 800° C. will not become 18 N/mm$^2$ or more. If the total of the contents of Cu and Sn exceeds 2.7%, Ti—Cu intermetallic compounds easily precipitate, so the Erichsen value no longer reaches 10 mm.

If the content of Si is 0.1% or less, the increase in mass by oxidation at continuous oxidation at 800° C. for 200 hours will not become 65 g/m$^2$ or less. If the amount of addition of Si is greater than 0.6%, the effect of suppression of the increase in mass by oxidation becomes saturated. Furthermore, twinning deformation of titanium is suppressed and Ti—Si intermetallic compounds greatly precipitate, so the Erichsen value does not reach 10 mm. If the total of the second phases (β-phases, Ti—Cu intermetallic compounds, and Ti—Si intermetallic compounds) exceeds 1.0%, the Erichsen value falls, so the volume fraction of the second phases has to be made 1.0% or less.

Due to the above, the amount of addition of Si is made over 0.1% to 0.6% or less. The more preferable lower limit of the content of Si is 0.3 or more, while the upper limit is 0.6% or less.

Fe is mixed in as an impurity from the sponge titanium or scrap. If the Fe content increases, the strength rises, but the workability falls and the β-phases increase, so the upper limit is made 0.15%. Preferably, it is 0.1% or less. More preferably it is 0.08% or less.

The titanium alloy of the present invention (2) further contains, by mass %, Nb: 1.0% or less. If Nb is contained jointly with Si, the high temperature oxidation resistance is further improved. To obtain the effect of improvement of the oxidation resistance, it is preferable to include Nb: 0.1% or more. Even if adding over 1.0% of Nb, the effect of improvement of the oxidation resistance becomes saturated, so the upper limit of the amount of addition is made 1.0%.

In a titanium alloy having the chemical composition of the present invention, sometimes there are second phases (β-phases, Ti—Cu intermetallic compounds, and Ti—Si intermetallic compounds). If the second phases exceed 1.0% by volume fraction in the final product, the Erichsen value is made to greatly decrease. The inventors discovered a method of production for suppressing the β-phases, Ti—Cu intermetallic compounds, and Ti—Si intermetallic compounds.

The method of eliminating Ti—Cu intermetallic compounds will be explained. To eliminate Ti—Cu intermetallic compound, it is necessary to make the temperature a temperature of the following formula (A) or more.

$$T_{Cu}=54.5\times[Cu]^3-230\times[Cu]^2+447\times[Cu]+403+20\times[Sn] \quad \text{Formula (A):}$$

Formula (A) shows the lower limit of the temperature for eliminating Ti—Cu intermetallic compounds found thermodynamically and experimentally. This is obtained by thermodynamically calculating the temperature at which ma single phase is obtained, obtaining a function most easily approximating it, then experimentally checking for the presence of Ti—Cu intermetallic compounds and correcting the coefficients. Furthermore, the temperature must be made one able to suppress β-phases.

In general, if the temperature becomes higher, the β-phase more easily precipitates, so from the viewpoint of suppressing the precipitation of β-phases, it is preferable to manage the upper limit of the annealing temperature by the content of Fe since the effect of the Fe included as an impurity is large.

If Fe is 0.05% or less, if less than 850° C., the amount of the β-phases formed after cooling is an amount of an extent not posing a problem. If over 0.05% to 0.1%, if 820° C. or less, the amount formed is of an extent not posing a problem. If the amount of Fe exceeds 0.1%, the annealing temperature has to be made 780° C. or less, so a limit arises in the components prescribed in the present application. Further, if over 0.15%, at the temperature of the formula (A) or more, there is no longer a temperature region where β-phases are not formed. That is, if in particular the Fe content in the alloy composition becomes greater, the temperature at which the β phase-layers are formed sometimes becomes lower than (A).

In this way, it is necessary to set the upper limit of the solution heat treatment temperature of the Ti—Cu intermetallic compounds in accordance with the amount of Fe. Further, regarding the cooling rate, Ti—Cu intermetallic compounds precipitate slowly, so the amount of precipitation does not become one posing a problem even with the extent of furnace cooling. From the above, by annealing at the temperature of the formula (A) or more and less than the upper limit temperature determined by the Fe content, it is possible to suppress Ti—Cu intermetallic compounds and the β-phases. This annealing has to be performed before the final annealing and may be performed by hot rolled sheet annealing.

Next, the method of eliminating Ti—Si intermetallic compounds will be explained.

To eliminate the Ti—Si intermetallic compounds, it is necessary to make the temperature a temperature of the following formula (B) or more.

$$T_{Si}=3995\times[Si]^3-6825\times[Si]^2+4000\times[Si]+40 \quad \text{Formula (B):}$$

Formula (B), in the same way as the Ti—Cu intermetallic compounds, shows the lower limit of the temperature for eliminating Ti—Si intermetallic compounds found thermodynamically and experimentally.

Further, as explained above, Ti—Si intermetallic compounds are fast in precipitation rate. For this reason, in the annealing process including at least the final annealing, the material must be cooled by a cooling rate of 0.5° C./s or more down to 550° C. or less. If annealing at a thickness where the cooling rate cannot be made 0.5° C./s or more, while there is no problem in BAF annealing as well, the cold workability falls, so it is necessary to make the cold rolling rate one where edge cracking does not occur at the time of cold rolling. The upper limit of the annealing temperature is made the same upper limit temperature as the Ti—Cu intermetallic compounds so as to suppress the formation of β-phases.

By the method of production explained above, it is possible to keep the total amount of the second phases of the β-phases, Ti—Cu intermetallic compounds, and Ti—Si intermetallic compounds down to 1.0% or less.

The present invention (3) is an exhaust system using the titanium alloy material of the present invention (1) or (2). The titanium alloy material of the present invention has an Erichsen value of the JIS class 2 commercially pure titanium or more, so cold rolled annealed sheets can be bent into tubular shapes and TIG welded, expanded or drawn into different parts, bent, and welded together to obtain an exhaust system.

Note that even an exhaust system using a muffler provided with a catalyst having the function of a catalyst device and the function of a muffler is included in the scope of the present invention needless to say so long as an exhaust system in which one or more of the exhaust manifold, exhaust pipe, and muffler provided with a catalyst is comprised of a titanium alloy of the present invention (1) or (2).

EXAMPLES

Below, examples will be given to explain the constitution and actions and effects of the present invention more specifically.

Example 1

A titanium material of a composition which is shown in Table 1 was melted by a vacuum arc remelting furnace (hereinafter referred to as "VAR") and hot forged to a slab. This was heated to 860° C., then was hot rolled by a continuous hot rolling mill to a strip of a thickness of 3.5 mm. This hot rolled strip was annealed in the atmosphere, then the oxide scale was removed by shot blasting and pickling, then the strip was cold rolled to a thickness of 1 mm, then was annealed. The annealing conditions and finish annealing conditions of the hot rolled strip are described in Table 1. The finish annealing was performed in Ar gas.

Note that, in No. 27, the descaled hot rolled strip was cold rolled by a cold rolling rate of about 30% and intermediately annealed as described in Table 1 two times each. Further, it was cold rolled by a cold rolling rate of about 40% to obtain 1 mm thick cold rolled strip.

From the obtained titanium alloy strip, an Erichsen test piece was cut out and subjected to an Erichsen test using a Teflon sheet. In a muffler, bulging and deep drawing are performed. The Erichsen test was used for evaluating formability closer to the actual state. For the lubrication of the Erichsen test, a Teflon sheet of a thickness of 50 μm was used.

Further, a high temperature tensile test was performed at 800° C. based on JIS G 0567. In a high temperature oxidation test, a 20 mm×20 mm test piece was polished at its surface and end parts by #400 sandpaper, then exposed to a temperature of 800° C. in the air for 200 hours. The change in mass before and after the test was measured and the increase in mass by oxidation per unit cross-sectional area was found.

The second phases were observed by observing the structure by a scan type electron microscope and the area fraction was calculated by the image analysis method to find the total of the volume fraction of the β-phases and $Ti_2Cu$ and the volume fraction of the silicide. Note that, in the image formed at the scan type electron microscope, Ti—Si intermetallic compounds are observed as blacker than the base phase. The β-phases and the Ti—Cu intermetallic compounds are observed whiter than the base phase, so the volume fraction can be found by image analysis. The range of measurement of the area fraction was made 500 μm×500 μm (250000 $\mu m^2$).

The chemical compositions and manufacturing conditions are shown in Table 1 while the obtained results are shown in Table 2. The solid solution temperature-based Cu(A) and Si(B) in the table respectively are the temperatures found by the above-mentioned formula (A) and formula (B). The Cu(A) upper limit shows the upper limit of the solid solution heat treatment temperature of the Ti—Cu intermetallic compounds corresponding to the amount of Fe (same in Table 3 and Table 5).

TABLE 1

| | Chemical composition (mass %) | | | | | | | Conditional expression | | | Hot rolled sheet annealing | | | Intermediate annealing | | | Finishing annealing | | | |
|---|---|---|---|---|---|---|---|---|---|---|---|---|---|---|---|---|---|---|---|---|
| No. | Cu | Sn | Si | Nb | Fe | O | Cu + Sn | Cu(A) | β-up. limit | Si(B) | Temp./ °C. | Time | Cool-ing | Temp./ °C. | Time | Cool-ing | Temp. | Time | Cool-ing | |
| 1 | 0.8 | 0.7 | 0.5 | — | 0.05 | 0.09 | 1.5 | 655.3 | 850 | 833.1 | 840 | 1 min | 0.5 | — | — | — | 840 | 2 min | 0.5 | Inv. ex. |
| 2 | 1 | 0.8 | 0.4 | — | 0.05 | 0.06 | 1.8 | 690.5 | 850 | 803.7 | 810 | 1 min | 0.5 | — | — | — | 810 | 2 min | 1.0 | Inv. ex. |
| 3 | 1.1 | 1 | 0.3 | — | 0.05 | 0.05 | 2.1 | 708.9 | 850 | 733.6 | 740 | 1 min | 0.5 | — | — | — | 750 | 5 min | 5.0 | Inv. ex. |
| 4 | 1.2 | 1.2 | 0.2 | — | 0.06 | 0.04 | 2.4 | 726.4 | 820 | 599.0 | 740 | 1 min | 0.5 | — | — | — | 800 | 5 min | 5.0 | Inv. ex. |
| 5 | 0.5 | 1.4 | 0.5 | 0.3 | 0.05 | 0.03 | 1.9 | 603.8 | 850 | 833.1 | 840 | 1 min | 0.5 | — | — | — | 840 | 5 min | 2.0 | Inv. ex. |
| 6 | 1 | 1 | 0.4 | 0.5 | 0.04 | 0.06 | 2.0 | 694.5 | 850 | 803.7 | 810 | 1 min | 0.5 | — | — | — | 810 | 5 min | 2.0 | Inv. ex. |
| 7 | 1 | 1 | 0.4 | 0.5 | 0.04 | 0.06 | 2.0 | 694.5 | 850 | 803.7 | 750 | 1 min | 0.5 | — | — | — | 810 | 5 min | 1.0 | Inv. ex. |
| 8 | 1 | 1 | 0.4 | 0.5 | 0.04 | 0.06 | 2.0 | 694.5 | 850 | 803.7 | 750 | 1 min | 0.5 | — | — | — | 780 | 5 min | 1.0 | Comp. ex. |
| 9 | 1 | 1 | 0.4 | 0.5 | 0.04 | 0.06 | 2.0 | 694.5 | 850 | 803.7 | 650 | 1 min | 0.5 | — | — | — | 810 | 5 min | 1.0 | Comp. ex. |
| 10 | 1 | 1 | 0.4 | 0.5 | 0.04 | 0.06 | 2.0 | 694.5 | 850 | 803.7 | 650 | 1 min | 0.5 | — | — | — | 780 | 5 min | 1.0 | Comp. ex. |
| 11 | 1.5 | 1 | 0.3 | 0.7 | 0.06 | 0.05 | 2.5 | 759.9 | 820 | 733.6 | 770 | 1 min | 0.5 | — | — | — | 800 | 5 min | 5.0 | Inv. ex. |
| 12 | 1.5 | 1 | 0.3 | 0.7 | 0.06 | 0.05 | 2.5 | 759.9 | 820 | 733.6 | 770 | 1 min | 0.5 | — | — | — | 720 | 5 min | 1.0 | Comp. ex. |
| 13 | 1.5 | 1 | 0.3 | 0.7 | 0.06 | 0.05 | 2.5 | 759.9 | 820 | 733.6 | 700 | 1 min | 0.5 | — | — | — | 740 | 5 min | 1.0 | Comp. ex. |
| 14 | 1.5 | 1 | 0.3 | 0.7 | 0.06 | 0.05 | 2.5 | 759.9 | 820 | 733.6 | 700 | 1 min | 0.5 | — | — | — | 720 | 5 min | 1.0 | Comp. ex. |
| 15 | 1.5 | 1 | 0.3 | 0.7 | 0.06 | 0.05 | 2.5 | 759.9 | 820 | 733.6 | 740 | 1 min | 0.5 | — | — | — | 740 | 5 min | 1.0 | Comp. ex. |
| 16 | 1.5 | 1 | 0.3 | 0.7 | 0.06 | 0.05 | 2.5 | 759.9 | 820 | 733.6 | 840 | 1 min | 0.5 | — | — | — | 780 | 5 min | 1.0 | Comp. ex. |
| 17 | 1 | 0.5 | 0.2 | 0.8 | 0.06 | 0.05 | 1.5 | 684.5 | 820 | 599.0 | 700 | 1 min | 0.5 | — | — | — | 750 | 5 min | 5.0 | Inv. ex. |
| 18 | 1.7 | 0.1 | 0.2 | — | 0.05 | 0.04 | 1.8 | 768.0 | 850 | 599.0 | 800 | 1 min | 0.5 | — | — | — | 800 | 2 min | 5.0 | Comp. ex. |
| 19 | 0.2 | 1.4 | 0.2 | — | 0.06 | 0.05 | 1.6 | 511.6 | 820 | 599.0 | 800 | 1 min | 0.5 | — | — | — | 700 | 2 min | 5.0 | Comp. ex. |
| 20 | 0.5 | 0.5 | 0.3 | — | 0.04 | 0.05 | 1.0 | 585.8 | 850 | 733.6 | 800 | 1 min | 0.5 | — | — | — | 780 | 2 min | 5.0 | Comp. ex. |
| 21 | 1.1 | 1 | 0 | — | 0.03 | 0.05 | 2.1 | 708.9 | 850 | 40.0 | 800 | 1 min | 0.5 | — | — | — | 770 | 2 min | 1.0 | Comp. ex. |
| 22 | 1 | 0.5 | 0.8 | — | 0.05 | 0.05 | 1.5 | 684.5 | 850 | 917.4 | 800 | 1 min | 0.5 | — | — | — | 920 | 2 min | 1.0 | Comp. ex. |
| 23 | 1.5 | 1 | 0.7 | 0.7 | 0.05 | 0.05 | 2.5 | 759.9 | 850 | 866.0 | 800 | 1 min | 0.5 | — | — | — | 830 | 5 min | 1.0 | Comp. ex. |
| 24 | 1.4 | 1.3 | 0.3 | — | 0.05 | 0.13 | 2.7 | 753.5 | 850 | 733.6 | 800 | 1 min | 0.5 | — | — | — | 780 | 5 min | 1.0 | Comp. ex. |
| 25 | 1.5 | 1.5 | 0.2 | — | 0.05 | 0.04 | 3.0 | 769.9 | 850 | 599.0 | 800 | 1 min | 0.5 | — | — | — | 780 | 5 min | 1.0 | Comp. ex. |
| 26 | 0.5 | 2 | 0.3 | 0.2 | 0.06 | 0.03 | 2.5 | 615.8 | 820 | 733.6 | 800 | 1 min | 0.5 | — | — | — | 800 | 5 min | 1.0 | Comp. ex. |
| 27 | Ti—3Al—2.5V | | | | | | | | — | | 800 | 1 min | 0.5 | 800 | 1 min | 0.5 | 800 | 5 min | 1 | Comp. ex. |

TABLE 2

| | Second phase volume rate (%) | | | High temperature tension (Proof stress) | Increase in mass by oxidation | Erichsen | |
|---|---|---|---|---|---|---|---|
| No. | β + Ti2Cu phases | Silicide | Total | MPa | g/m$^2$ | mm | |
| 1 | 0.4 | 0.6 | 1.0 | 19 | 51.4 | 10.3 | Inv. ex. |
| 2 | 0.2 | 0.7 | 0.9 | 20 | 55.9 | 10.3 | Inv. ex. |
| 3 | 0.1 | 0.5 | 0.6 | 23 | 57.2 | 10.4 | Inv. ex. |
| 4 | 0.0 | 0.1 | 0.1 | 26 | 59.6 | 10.3 | Inv. ex. |
| 5 | 0.4 | 0.5 | 0.9 | 21 | 36.3 | 10.3 | Inv. ex. |
| 6 | 0.4 | 0.5 | 0.9 | 22 | 34.2 | 10.2 | Inv. ex. |
| 7 | 0.3 | 0.5 | 0.8 | 22 | 33.9 | 10.1 | Inv. ex. |
| 8 | 0.4 | 0.7 | 1.1 | 20 | 33.8 | 9.8 | Comp. ex. |
| 9 | 0.7 | 0.5 | 1.2 | 21 | 34.5 | 9.6 | Comp. ex. |
| 10 | 0.8 | 0.8 | 1.6 | 20 | 34.2 | 9.7 | Comp. ex. |
| 11 | 0.5 | 0.4 | 0.9 | 27 | 33.9 | 10.3 | Inv. ex. |
| 12 | 0.8 | 0.7 | 1.5 | 24 | 33.8 | 9.8 | Comp. ex. |
| 13 | 0.8 | 0.5 | 1.3 | 26 | 34.2 | 9.8 | Comp. ex. |
| 14 | 1.1 | 0.6 | 1.7 | 23 | 34.6 | 9.6 | Comp. ex. |
| 15 | 0.7 | 0.4 | 1.1 | 26 | 33.9 | 9.7 | Comp. ex. |
| 16 | 0.5 | 0.6 | 1.1 | 25 | 34.1 | 9.7 | Comp. ex. |
| 17 | 0.0 | 0.0 | 0.0 | 26 | 36.5 | 10.5 | Inv. ex. |
| 18 | 2.1 | 0.1 | 2.2 | 17 | 58.7 | 9.6 | Comp. ex. |
| 19 | 0.0 | 0.0 | 0.0 | 15 | 61.2 | 10.8 | Comp. ex. |
| 20 | 0.0 | 0.3 | 0.3 | 11 | 52.3 | 10.6 | Comp. ex. |
| 21 | 0.0 | 0.0 | 0.0 | 22 | 115.8 | 10.7 | Comp. ex. |
| 22 | 2.4 | 0.2 | 2.6 | 18 | 50.8 | 8.8 | Comp. ex. |
| 23 | 0.5 | 2.4 | 2.9 | 23 | 59.8 | 9.3 | Comp. ex. |
| 24 | 0.2 | 0.4 | 0.6 | 24 | 58.1 | 9.1 | Comp. ex. |
| 25 | 1.6 | 0.1 | 1.7 | 26 | 59.7 | 9.5 | Comp. ex. |
| 26 | 0.2 | 0.3 | 0.5 | 24 | 43.6 | 9.2 | Comp. ex. |
| 27 | Not investigated | | | 28 | 292.2 | 8.6 | Comp. ex. |

In No. 18 where the amount of Sn is small, No. 19 where the amount of Cu is small, and No. 20 where the amount of Cu+Sn is small, the 0.2% proof stress at 800° C. failed to reach 18 N/mm$^2$. Further, in No. 18, Cu is added exceeding the upper limit. If the solid solution temperature is exceeded, the amount of β-phases precipitated becomes greater, so Cu concentrates at the β-phases and $Ti_2Cu$ precipitates at 1.0% or more during cooling, so the Erichsen value becomes low.

In No. 21, where Si and Nb are not added, the increase in mass by oxidation at 800° C. is remarkably high and the oxidation resistance is poor as a result.

In No. 22 where the content of Si exceeds the upper limit of the present invention, the Si solid solution temperature is higher than the β-transformation point, so an equiaxed structure cannot be obtained. In addition, the volume fraction of the second phases exceeds 1.0% and the Erichsen value is low.

In No. 23, the Si solid solution temperature is higher than the annealing upper limit temperature, so the volume fraction of second phases is over 1.0% and the Erichsen value is low.

In Nos. 8 and 12, the hot rolled sheet annealing temperature is higher than the Cu solid solution temperature, but the finishing annealing temperature is lower than the Si solid solution temperature, so the volume fraction of second phases exceeds 1.0% and the Erichsen value is low.

In Nos. 9, 10, 13, 14, and 15, the hot rolled sheet annealing temperature is lower than the Cu solid solution temperature, so both if performing the finishing annealing at a temperature of the Si solid solution temperature or more or at the Si solid solution temperature or less, the volume fraction of the second phases exceeds 1.0% and the Erichsen value is low.

In No. 24 where the content of oxygen exceeds the upper limit of the present invention, No. 25 where the amount of Cu+Sn exceeds the upper limit of the present invention, and No. 26 where the amount of Sn exceeds the upper limit of the present invention as well, the Erichsen value becomes low.

In No. 16, the hot rolled sheet annealing temperature is higher than the Cu solid solution temperature, but exceeds the annealing upper limit temperature, the volume fraction of the second phases exceeds 1.0%, and the Erichsen value is low.

In No. 27 including Al: 3 mass % and V: 2.5 mass %, the 0.2% proof stress at 800° C. is high and the high temperature strength is excellent, but the Erichsen value is low. Further, the increase in mass by oxidation at 800° C. also exceeds 65 g/m$^2$. A sufficient oxidation resistance is not obtained.

Example 2

A titanium alloy of each of the compositions of ingredients which are shown in Table 3 was melted by a VAR and hot forged to a slab. This was heated to 860° C., then was hot rolled to a thickness of 5 mm. The oxide scale of the hot rolled sheet was removed by shot blasting and pickling, the strip was cold rolled by a cold rolling rate of about 20% and intermediately annealed, then was finally cold rolled by a cold rolling rate of about 75%, cold rolled to a thickness of 1 mm, then finish annealed. The intermediate annealing was performed by removing the scale by pickling after annealing in the air or by vacuum annealing under the conditions of Table 3. The finishing annealing was performed in Ar gas under the conditions of Table 3. From the obtained titanium alloy sheet, test pieces were taken and subjected to tests under test conditions similar to Example 1.

TABLE 3

| | Chemical composition (mass %) | | | | | | | Conditional expression | | | Hot rolled sheet annealing | | |
|---|---|---|---|---|---|---|---|---|---|---|---|---|---|
| No. | Cu | Sn | Si | Nb | Fe | O | Cu + Sn | Cu(A) | β-upper limit | Si(B) | Temp./ ° C. | Time | Cooling |
| 28 | 1.2 | 1.2 | 0.3 | — | 0.03 | 0.05 | 2.4 | 718.4 | 850 | 733.6 | — | — | — |
| 29 | 1.2 | 1.2 | 0.3 | — | 0.03 | 0.05 | 2.4 | 718.4 | 850 | 733.6 | — | — | — |
| 30 | 1.2 | 1.2 | 0.3 | — | 0.03 | 0.05 | 2.4 | 718.4 | 850 | 733.6 | — | — | — |
| 31 | 1.2 | 1.2 | 0.3 | — | 0.03 | 0.05 | 2.4 | 718.4 | 850 | 733.6 | — | — | — |
| 32 | 1.2 | 1.2 | 0.3 | — | 0.03 | 0.05 | 2.4 | 718.4 | 850 | 733.6 | — | — | — |
| 33 | 1.2 | 1.2 | 0.3 | — | 0.03 | 0.05 | 2.4 | 718.4 | 850 | 733.6 | — | — | — |
| 34 | 1.2 | 1.2 | 0.3 | — | 0.03 | 0.05 | 2.4 | 718.4 | 850 | 733.6 | — | — | — |
| 35 | 1.2 | 1.2 | 0.3 | — | 0.03 | 0.05 | 2.4 | 718.4 | 850 | 733.6 | — | — | — |
| 36 | 1.2 | 1.2 | 0.3 | — | 0.03 | 0.05 | 2.4 | 718.4 | 850 | 733.6 | — | — | — |
| 37 | 1 | 1 | 0.5 | 0.3 | 0.04 | 0.03 | 2.0 | 687.8 | 850 | 833.1 | 840 | 2 min | 0.4 |
| 38 | 1 | 1 | 0.5 | 0.3 | 0.04 | 0.03 | 2.0 | 687.8 | 850 | 833.1 | 840 | 2 min | 0.4 |
| 39 | 1 | 1 | 0.5 | 0.3 | 0.04 | 0.03 | 2.0 | 687.8 | 850 | 833.1 | 840 | 2 min | 0.4 |
| 40 | 1 | 1 | 0.5 | 0.3 | 0.04 | 0.03 | 2.0 | 687.8 | 850 | 833.1 | 840 | 2 min | 0.4 |
| 41 | 1 | 1 | 0.5 | 0.3 | 0.04 | 0.03 | 2.0 | 687.8 | 850 | 833.1 | 840 | 2 min | 0.4 |
| 42 | 0.8 | 0.8 | 0.4 | 0.5 | 0.08 | 0.05 | 1.6 | 652.0 | 820 | 803.7 | 780 | 2 min | 0.4 |
| 43 | 0.8 | 0.8 | 0.4 | 0.5 | 0.08 | 0.05 | 1.6 | 652.0 | 820 | 803.7 | 780 | 2 min | 0.4 |
| 44 | 0.8 | 0.8 | 0.4 | 0.5 | 0.08 | 0.05 | 1.6 | 652.0 | 820 | 803.7 | 780 | 2 min | 0.4 |
| 45 | 0.8 | 0.8 | 0.4 | 0.5 | 0.06 | 0.05 | 1.6 | 652.0 | 820 | 803.7 | 780 | 2 min | 0.4 |

| | Intermediate annealing | | | Finishing annealing | | | |
|---|---|---|---|---|---|---|---|
| No. | Temp./ ° C. | Time | Cooling | Temp./ ° C. | Time | Cooling/ ° C./s | |
| 28 | 740 | 2 min | 0.5 | 750 | 5 min | 5 | Inv. ex. |
| 29 | 650 | 2 min | 0.5 | 750 | 5 min | 5 | Comp. ex. |
| 30 | 720 | 2 min | 0.5 | 750 | 5 min | 5 | Inv. ex. |
| 31 | 650 | 2 min | 0.5 | 720 | 5 min | 5 | Comp. ex. |
| 32 | 720 | 2 min | 0.5 | 700 | 5 min | 5 | Comp. ex. |
| 33 | 700 | 4 h | 0.01 | 740 | 5 min | 5 | Comp. ex. |
| 34 | 720 | 4 h | 0.01 | 740 | 5 min | 5 | Inv. ex. |

TABLE 3-continued

| | | | | | | | |
|---|---|---|---|---|---|---|---|
| 35 | 720 | 2 min | 0.5 | 740 | 4 h | 0.01 | Comp. ex. |
| 36 | 720 | 4 h | 0.01 | 700 | 4 h | 0.01 | Comp. ex. |
| 37 | 840 | 2 min | 0.5 | 840 | 2 min | 1 | Inv. ex. |
| 38 | 840 | 2 min | 0.5 | 840 | 2 min | 0.1 | Comp. ex. |
| 39 | 840 | 2 min | 0.5 | 850 | 2 min | 1 | Comp. ex. |
| 40 | 650 | 2 mm | 0.5 | 840 | 2 min | 1 | Inv. ex. |
| 41 | 650 | 4 h | 0.01 | 840 | 2 min | 1 | Comp. ex. |
| 42 | 780 | 2 min | 0.5 | 810 | 2 min | 5 | Inv. ex. |
| 43 | 780 | 2 min | 0.5 | 800 | 2 min | 5 | Comp. ex. |
| 44 | 650 | 2 min | 0.5 | 810 | 2 min | 5 | Inv. ex. |
| 45 | 650 | 4 h | 0.01 | 810 | 2 min | 5 | Comp. ex. |

TABLE 4

| | Second phase volume rate (%) | | | High temp. tension (Proof stress) | Increase of mass by oxidation | Erichsen | |
|---|---|---|---|---|---|---|---|
| No. | β + Ti2Cu phases | Silicide | Total | MPa | g/m2 | mm | |
| 28 | 0.3 | 0.5 | 0.8 | 26 | 56.2 | 10.3 | Inv. ex. |
| 29 | 0.8 | 0.3 | 1.1 | 24 | 55.3 | 9.7 | Comp. ex. |
| 30 | 0.2 | 0.4 | 0.6 | 27 | 55.4 | 10.3 | Inv. ex. |
| 31 | 0.7 | 0.4 | 1.1 | 25 | 55.8 | 9.8 | Comp. ex. |
| 32 | 0.6 | 0.5 | 1.1 | 24 | 55.8 | 9.9 | Comp. ex. |
| 33 | 0.7 | 0.4 | 1.1 | 25 | 56.3 | 9.8 | Comp. ex. |
| 34 | 0.3 | 0.4 | 0.7 | 27 | 55.7 | 10.2 | Inv. ex. |
| 35 | 0.5 | 0.6 | 1.1 | 25 | 55.2 | 9.8 | Comp. ex. |
| 36 | 1.2 | 0.5 | 1.7 | 23 | 55.8 | 9.6 | Comp. ex. |
| 37 | 0.5 | 0.4 | 0.9 | 23 | 34.6 | 10.6 | Inv. ex. |
| 38 | 0.2 | 1.8 | 2 | 20 | 35.2 | 9.3 | Comp. ex. |
| 39 | 0.9 | 0.6 | 1.5 | 21 | 34.8 | 9.6 | Comp. ex. |
| 40 | 0.4 | 0.5 | 0.9 | 21 | 35.1 | 10.3 | Inv. ex. |
| 41 | 0.7 | 0.7 | 1.4 | 21 | 34.6 | 9.5 | Comp. ex. |
| 42 | 0.4 | 0.6 | 1.0 | 20 | 35.7 | 10.2 | Inv. ex. |
| 43 | 0.5 | 0.9 | 1.4 | 18 | 35.5 | 9.8 | Comp. ex. |
| 44 | 0.4 | 0.5 | 0.9 | 19 | 34.1 | 10.2 | Inv. ex. |
| 45 | 0.5 | 0.8 | 1.3 | 19 | 33.4 | 9.7 | Comp. ex. |

The result is shown in Table 4. In Nos. 29 and 33, hot rolled sheet annealing is not performed. Intermediate annealing is performed at a lower temperature than the Cu solid solution temperature regardless of being by the method of continuous annealing or batch annealing. Even if the finishing annealing temperature is higher than the Si solid solution temperature, the volume fraction of the second phases exceeds 1.0% and the Erichsen value is low.

In Nos. 31 and 32, the finishing annealing temperature is lower than the Si solid solution temperature. Regardless of the intermediate annealing temperature, the volume fraction of the second phases exceeds 1.0% and the Erichsen value is low.

In Nos. 35 and 36, the finishing annealing is performed by the batch system, so the cooling rate is slow, the second phases exceed 1.0%, and the Erichsen value is low.

In No. 38, the cooling rate is slow, so the second phases exceed 1.0% and the Erichsen value is low.

In No. 39, the finishing annealing temperature is right above the upper limit temperature, so the volume fraction of the second phases is over 1.0% and the Erichsen value is low.

In Nos. 41 and 45, the hot rolled sheet annealing temperature is higher than the Cu solid solution temperature, but the intermediate annealing is performed by batch annealing at a temperature lower than the Cu solid solution temperature, so the volume fraction of the second phases is over 1.0% and the Erichsen value is low.

In Nos. 40 and 44 where intermediate annealing is performed by the continuous system, the time where the sheets are held at a temperature where Ti—Cu intermetallic compounds precipitate is short, so it is possible to suppress the second phases.

In No. 43, the finishing annealing temperature is lower than the Si solid solution temperature, so the volume fraction of the second phases is over 1.0% and the Erichsen value is low.

Example 3

A titanium alloy of each of the compositions of ingredients which are shown in Table 5 was melted by a VAR and hot forged to a slab. This was heated to 860° C., then was hot rolled to a thickness of 12 mm. This hot rolled strip was annealed in the air, then the oxide scale was removed by shot blasting and pickling, the strip was cold rolled by a cold rolling rate of about 70% and intermediately annealed, then was finally cold rolled by a cold rolling rate of about 70%, cold rolled to a thickness of 1 mm, then finish annealed.

The intermediate annealing was performed by removing the scale by pickling after annealing in the air or vacuum annealing under the conditions of Table 3. The finishing annealing was performed in Ar gas under the conditions of Table 5. From the obtained titanium alloy sheet, test pieces were taken and subjected to tests under test conditions similar to Example 1 and Example 2.

TABLE 5

| | Chemical composition (mass %) | | | | | | | Conditional expression | | | Hot rolled sheet annealing | | |
|---|---|---|---|---|---|---|---|---|---|---|---|---|---|
| No. | Cu | Sn | Si | Nb | Fe | O | Cu + Sn | Cu(A) | β-upper limit | Si(B) | Temp./ ° C. | Time | Cooling |
| 46 | 0.8 | 1 | 0.15 | 0.2 | 0.14 | 0.06 | 1.8 | 661.3 | 780 | 499.9 | 770 | 1 min | 0.2 |
| 47 | 0.8 | 1 | 0.15 | 0.2 | 0.14 | 0.06 | 1.8 | 661.3 | 780 | 499.9 | 650 | 1 min | 0.2 |
| 48 | 0.8 | 1 | 0.15 | 0.2 | 0.14 | 0.06 | 1.8 | 661.3 | 780 | 499.9 | 650 | 4 h | 0.01 |
| 49 | 0.8 | 1 | 0.15 | 0.2 | 0.14 | 0.06 | 1.8 | 661.3 | 780 | 499.9 | 650 | 4 h | 0.01 |
| 50 | 0.8 | 1 | 0.15 | 0.2 | 0.14 | 0.06 | 1.8 | 661.3 | 780 | 499.9 | 650 | 4 h | 0.01 |
| 51 | 0.8 | 1 | 0.15 | 0.2 | 0.14 | 0.06 | 1.8 | 661.3 | 780 | 499.9 | 800 | 1 min | 0.2 |

| | Intermediate annealing | | | Finishing annealing | | | |
|---|---|---|---|---|---|---|---|
| No. | Temp./ ° C. | Time | Cooling | Temp./ ° C. | Time | Cooling/ ° C./s | |
| 46 | 750 | 1 min | 0.5 | 750 | 5 min | 1 | Inv. ex. |
| 47 | 750 | 1 min | 0.5 | 750 | 5 min | 1 | Inv. ex. |
| 48 | 750 | 1 min | 0.5 | 750 | 5 min | 1 | Inv. ex. |
| 49 | 680 | 4 h | 0.01 | 750 | 5 min | 1 | Inv. ex. |
| 50 | 800 | 1 min | 0.5 | 650 | 5 min | 1 | Inv. ex. |
| 51 | 650 | 4 h | 0.01 | 750 | 5 min | 1 | Comp. ex. |

TABLE 6

| | Second phase volume rate (%) | | | High temp. tension (Proof stress) | Increase in mass by oxidation | Erichsen | |
|---|---|---|---|---|---|---|---|
| No. | β + Ti2Cu phases | Silicide | Total | MPa | g/m2 | mm | |
| 46 | 0.3 | 0.0 | 0.3 | 20 | 43.3 | 10.4 | Inv. ex. |
| 47 | 0.3 | 0.0 | 0.3 | 20 | 43.3 | 10.4 | Inv. ex. |
| 48 | 0.4 | 0.1 | 0.5 | 20 | 43.9 | 10.3 | Inv. ex. |
| 49 | 0.4 | 0.1 | 0.5 | 21 | 43.1 | 10.2 | Inv. ex. |
| 50 | 0.4 | 0.0 | 0.4 | 18 | 44.1 | 10.1 | Inv. ex. |
| 51 | 1.3 | 0.1 | 1.4 | 19 | 44.3 | 9.7 | Comp. ex. |

Table 6 shows the results. In No. 50, the hot rolled sheet annealing is performed at a temperature higher than the Cu solid solution temperature and the sheet is annealed at a lower temperature than the Cu solid solution temperature in the intermediate annealing, but rolling is possible without edge trimming during cold rolling and there are no problems in characteristics.

In No. 41, the intermediate annealing temperature is low and the finishing annealing temperature is also low, so the second phases increase, so the Erichsen value is low. Edge trimming was performed twice during finishing cold rolling.

In No. 42, the hot rolled sheet annealing temperature is 850° C. and edge trimming was performed once during intermediate cold rolling. Further, the finishing annealing temperature is low, so there are many second phases and the Erichsen value is low.

In No. 43, the finishing annealing temperature is 850° C., there are many second phases, and the Erichsen value is low.

Example 4

A titanium alloy of a composition of ingredients which is shown in Table 1, No. 6 was melted by a VAR and hot forged to a slab. This was heated to 860° C., then was hot rolled by a hot continuous rolling mill to a strip of a thickness of 4 mm. This hot rolled strip was annealed at 780° C. for 5 minutes followed by air-cooling by continuous annealing (hot rolled sheet annealing), furthermore the oxide scale was removed by shot blasting and pickling, the strip was cold rolled to a thickness of 1 mm, then the strip was annealed by finish annealing at 810° C. for 5 minutes to obtain a titanium alloy sheet. Note that the cooling rate of the finishing annealing was 1° C./s.

The obtained titanium alloy sheet was cut out to a width of 120 mm and used to form a welded tube of an outside diameter of 38 mm. The tube was curved, then was welded by TIG welding to produce a welded tube. The process of production of a welded tube was made the same as the case of production using thin sheet based on JIS class 2 commercially pure titanium.

A 60° conical cone was pushed into the end of the welded tube to expand it to 1.3 times the initial diameter. At this time, no cracks occurred at the weld zone, so the expansion characteristics were good. Further, when the welded tube was bent 90° by a radius of 90 mm, no cracks or wrinkles resulted.

INDUSTRIAL APPLICABILITY

The titanium alloy material of the present invention is high in high temperature strength, superior in oxidation resistance, and also excellent in ductility at room temperature and enables manufacture of welded tubes as easily as a conventional pure titanium material. Therefore, it can be utilized for the main muffler parts of four-wheeled vehicles, motorcycles, and other automobiles of course and also for exhaust manifolds, exhaust pipes, catalyst devices, mufflers, and other exhaust system members. As a result, four-wheeled vehicles, motorcycles, and other automobiles are becoming lighter in weight, so the contribution to industry is extremely remarkable.

The invention claimed is:

1. A titanium alloy material containing, by mass %,

Cu: 0.5 to 1.5%,

Sn: 0.5 to 1.5%,

Si: over 0.1% to 0.6%,

O: 0.10% or less,

Fe: 0.15% or less, and a balance of Ti and impurities, having the total of the contents of Cu and Sn of 1.4 to 2.7%, and having the sum of the volume fractions of the β-phases and Ti—Cu and Ti—Si intermetallic compounds of 1.0% or less.

2. The titanium alloy material according to claim 1, further containing, by mass %, Nb: 1.0% or less.

3. An exhaust system comprising an exhaust manifold, exhaust pipe, catalyst device, and muffler, the exhaust system characterized by using a titanium alloy material described in claim 1 or 2 for one or more of the exhaust manifold, exhaust pipe, catalyst device, and muffler.

* * * * *